US006129241A

United States Patent [19]

Rai

[11] Patent Number: 6,129,241

[45] Date of Patent: Oct. 10, 2000

[54] PILL DISPENSER IN TOOTHBRUSH HANDLE

[76] Inventor: Kuljeet Singh Rai, 317B Casa Loma Rd., Morgan Hill, Calif. 95037

[21] Appl. No.: 09/248,718

[22] Filed: Feb. 10, 1999

[51] Int. Cl.[7] ..... A01C 9/00

[52] U.S. Cl. ..... 221/185; 222/93

[58] Field of Search ..... 221/185, 277, 221/135; 222/93

[56] References Cited

U.S. PATENT DOCUMENTS 3,586,212 6/1971 Tzouras ..... 222/93

*Primary Examiner*—Kenneth W. Noland
*Attorney, Agent, or Firm*—The Kline Law Firm

[57] ABSTRACT

A pill dispenser that is disposed in a handle of a toothbrush includes an auger mechanism constructed so that one complete turn of a dispensing knob causes the dispenser to eject a single pill from a port. The dispensing knob includes a safety mechanism that requires the knob to be pushed inward to engage the auger mechanism. The housing of the device, the toothbrush handle, is constructed so as to be waterproof so that no water is introduced to the pills in the dispenser. The ejection port is sealed so that there is no water introduction through the port. In addition, there is a labelling means provided so that the user can easily track the daily ingestion of the pills.

4 Claims, 4 Drawing Sheets

PILL DISPENSER IN TOOTHBRUSH HANDLE

FIELD OF THE INVENTION

The present invention relates generally to medication dispensing mechanisms, and more particularly is a pill dispenser disposed in a toothbrush handle.

BACKGROUND OF THE INVENTION

There are many devices in the prior art that provide variations on the structure of a toothbrush. One of the most common goals is to provide collapsible and/or dual purpose brushes for travellers, thereby reducing the space required to store toiletries in luggage.

Another goal of some prior art devices is to provide means to help users take medication with the proper dosages and with the proper frequency. One situation in which a consistent ingestion of medication is particularly crucial is a woman taking birth control pills.

Current art birth control pills utilize low dosage levels when compared with older birth control medications. For this reason, it is essential that the woman take the same dosage at the same time every day. Without this very consistent dosage, failures of the birth control pills can occur, which leads to an unwanted pregnancy for the user.

There is no device in the prior art that includes a means to combine two or more functions into a single device, and that provides a means of reminding a user to take a consistent dosage of a medication on a daily basis.

Accordingly, it is an object of the present invention to provide a toothbrush with a pill dispenser disposed in a handle of the toothbrush.

It is a further object of the present invention to provide a labelling method to allow a user to track the days relative to medication taken.

It is a still further object of the present invention to allow the combination of a toothbrush and a pill dispenser in a single device to reduce required storage space.

SUMMARY OF THE INVENTION

The present invention comprises a pill dispenser disposed in a handle of a toothbrush. The pill dispenser includes an auger mechanism. The dispenser is constructed so that one complete turn of a dispensing knob causes the dispenser to eject a single pill from a port. The dispensing knob includes a safety mechanism that requires the knob to be pushed inward to engage the auger mechanism.

The housing of the device, the toothbrush handle, is constructed so as to be waterproof so that no water is introduced to the pills in the dispenser. The ejection port is sealed so that there is no water introduction through the port.

In addition, there is a labelling means provided so that the user can easily track the daily ingestion of the pills.

An advantage of the present invention is that it provides a convenient means of reminding a user to take a pill each day by situating the pill dispenser in the handle of a toothbrush.

Another advantage of the present invention is that the dispenser includes a means to track the daily ingestion of the pills.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 7 shows the terminal end of the auger mechanism pushing a pill through the outlet port.

DETAILED DESCRIPTION OF THE INVENTION

Figure 1:
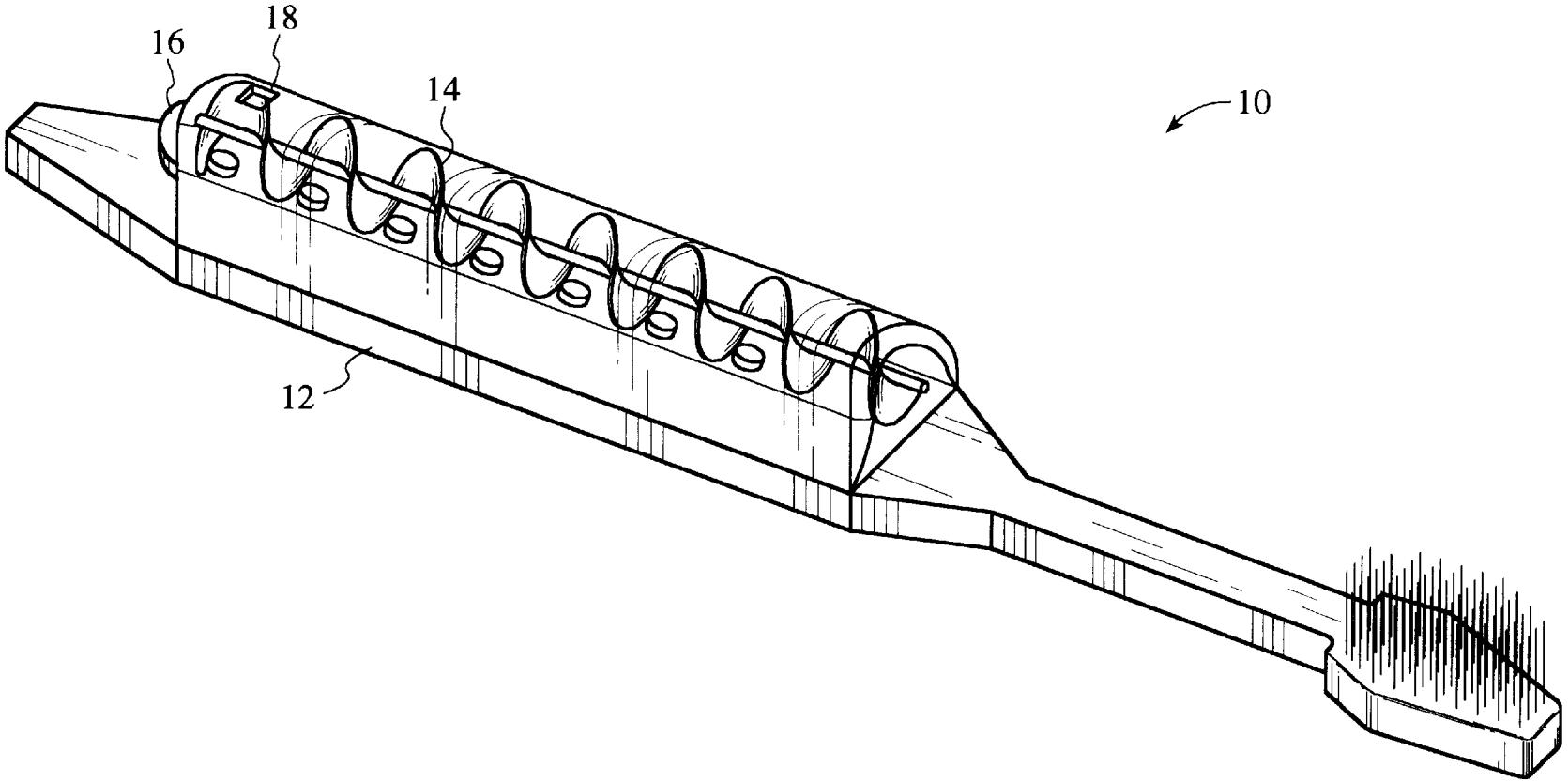
FIG. 1 is a perspective view of the combined pill dispenser and toothbrush of the present invention.
Figure 2:
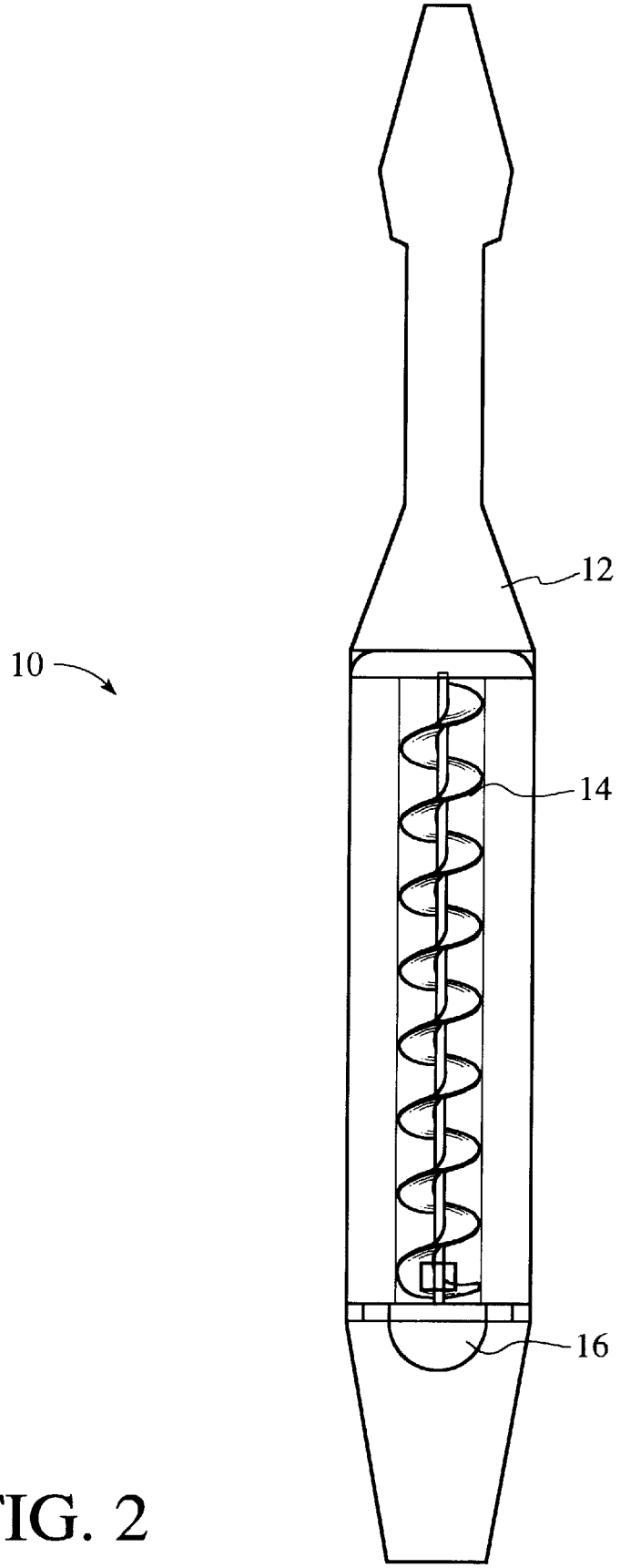
FIG. 2 is a front view of the device of the present invention.
Figure 3:
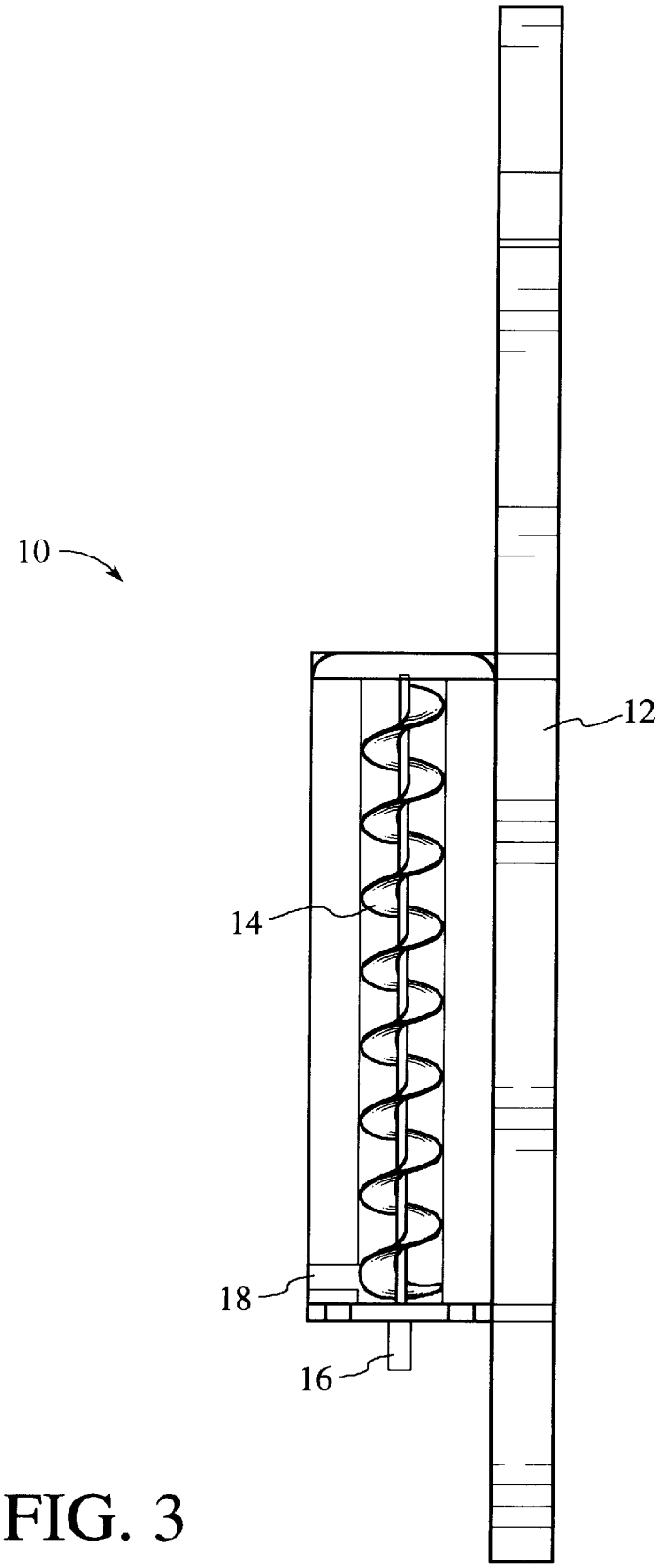
FIG. 3 is a side view of the device.
Figure 4:
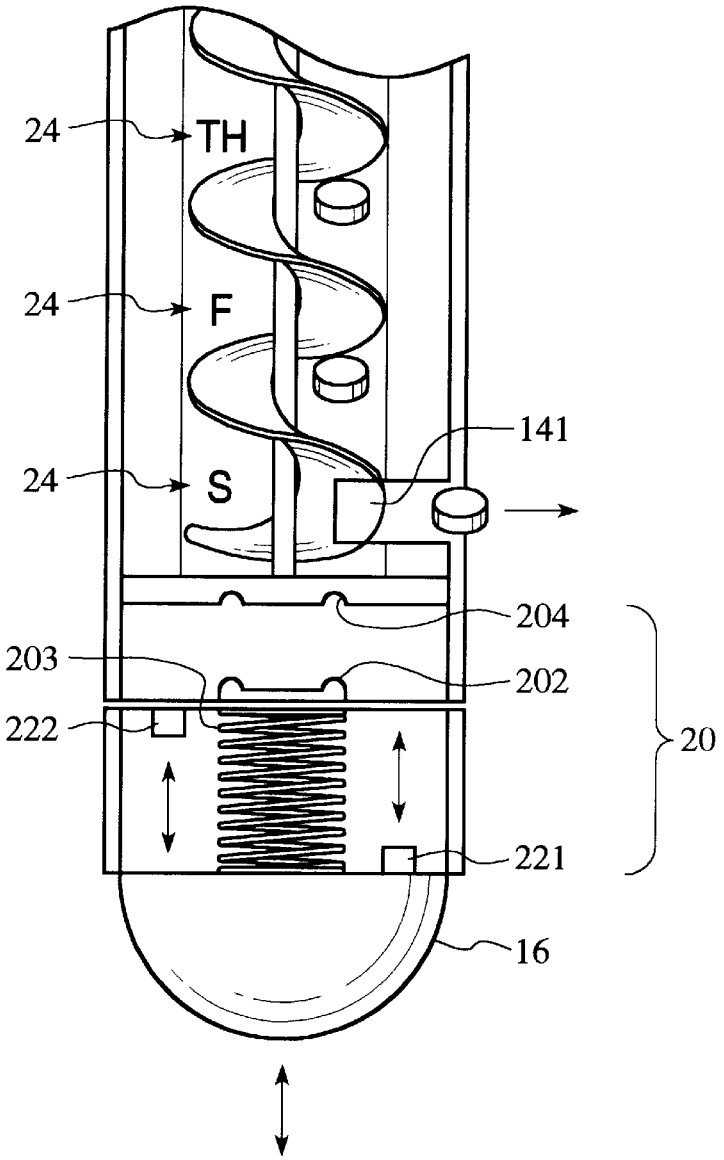
FIG. 4 is a bottom view of the device.
Figure 5:
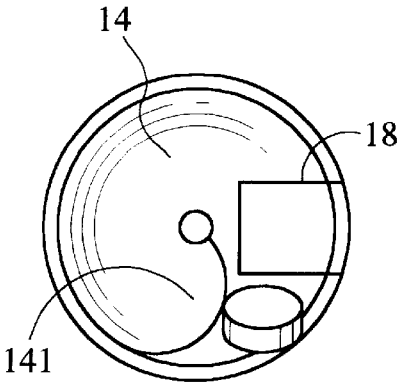
FIG. 5 is a detail view of the safety mechanism.
Figure 6:
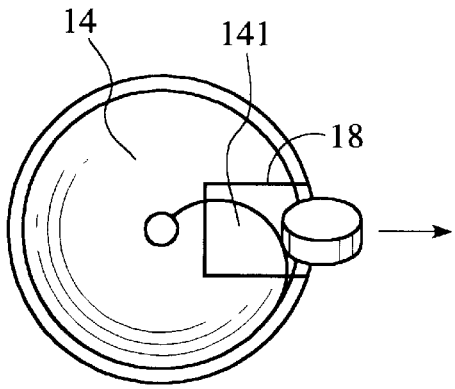
FIG. 6 shows the terminal end of the auger mechanism pushing a pill into the outlet port.

The present invention is an automatic pill dispenser 10 adapted to be disposed in the handle of a toothbrush 12. The pill dispenser 10 includes a central auger mechanism 14 that moves pills through the body of the toothbrush handle 12.

The pill dispenser 10 is constructed so that one complete revolution of a dispensing knob 16 causes the pill dispenser 10 to eject a single pill from a port 18. Causing the auger mechanism to dispense a pill with each revolution is easily accomplished by adjusting the thread pitch of the helical shaft that comprises the auger mechanism 14. Ensuring that only a single pill is dispensed is accomplished by a stop means 20.

The dispensing knob 16 includes a safety mechanism 20 that requires the dispensing knob 16 to be pushed inward to engage the auger mechanism 14. In the preferred embodiment, the safety mechanism comprises a pair of projections 201 extending from a engaging plate 202. The engaging plate 202 is mounted on a coil spring 203 that is affixed to an inner side of the dispensing knob 16. The projections 201 are received in a pair of recesses 204 in the lower end of the auger mechanism 14. The coil spring 203 pushes the dispensing knob 16 away from the auger mechanism 14 so that in a normal non-actuated position, the projections 201 are separated from the end of the auger mechanism 14. When the dispensing knob 16 is rotated in this inactive position, there is no effect on the auger mechanism 14.

To actuate the auger mechanism 14, a user must depress the dispensing knob 16 to overcome the force exerted by the spring 203. The projections 201 enter the recesses 202 so that the auger mechanism 14 is in communication with the dispensing knob 16. In this actuated position, rotating the dispensing knob 16 causes the auger mechanism 14 to also rotate. As the dispensing knob 16 is rotated through 3600, a terminal end 141 of the auger pushes a pill out through the port 18.

The stop means 22 comprises a first stop projection 221 and a second stop projection 222. The first stop projection protrudes inward from the inner side of the dispensing knob 16. The second stop projection protrudes outward from an upper surface of the engaging plate 202. When the dispensing knob 16 is pushed down to the actuated position and rotated, the first stop projection 221 will come into contact with the second stop projection 222 during each revolution of the auger mechanism 14 so that the dispensing knob 16 must be released and depressed again to complete another revolution and dispense a second pill.

The housing of the device, the toothbrush handle 12, is constructed to be waterproof so that no water is introduced to the pills in the dispenser. Since normal usage requires that a toothbrush be rinsed after each use, the sealing of the handle 12 and the ejection port 18 is quite important to the function of the pill dispenser 10.

In the preferred embodiment, a labelling means 24 is provided so that the user can easily track the daily ingestion of the pills. The labelling means 24 is simply a stick-on label with multiple sequences of the days of the week. The user trims the labelling means 24 so that the proper day is at the end of the label, and then affixes the label to the toothbrush handle 12. In this manner, the user can track her usage to be certain that no day's dosage has been missed.

While the above disclosure has been made with reference to birth control pills, it should be clear that various types of other medications, vitamins, etc., could as easily be dispensed from the pill dispenser of the present invention. Accordingly, the above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. An automatic pill dispenser disposed in the handle of a toothbrush comprising:

a central auger mechanism that moves pills through a body of the toothbrush handle, a terminal end of said auger mechanism pushes the pills through a port in the toothbrush handle, a dispensing means with a safety mechanism, said safety mechanism disables said dispensing means unless said dispensing means is placed in an actuated position, and a stop means to ensure that only one of the pills is dispensed per each actuation of the dispensing means; such that when said dispensing means is actuated, said dispensing means causes said auger mechanism to rotate through one revolution, thereby dispensing one of said pills through said port.

2. The pill dispenser of claim 1 wherein:

said safety mechanism comprises at least one projection extending from an engaging plate, said engaging plate is mounted on a coil spring that is affixed to an inner side of said dispensing means, said at least one projection is received in a corresponding at least one recess in a lower end of said auger mechanism; such that said coil spring pushes said dispensing means away from said auger mechanism when said dispensing means is in a non-actuated position, said projection does not engage said recess so that said dispensing means has no effect on said auger mechanism, and when said dispensing means is actuated, said projection engages said recess so that said auger mechanism is in communication with said dispensing means, and when said dispensing means is rotated, said auger mechanism is also rotated so that a terminal end of said auger pushes a pill out through said port.

3. The pill dispenser of claim 1 wherein:

said stop means comprises a first stop projection and a second stop projection, said first stop projection protrudes inward from an inner side of said dispensing means, said second stop projection protrudes outward from an upper surface of an engaging plate, said first stop projection contacts said second stop projection during each revolution of the auger mechanism, thereby prohibiting further rotation of said auger mechanism.

4. An automatic pill dispenser disposed in the handle of a toothbrush comprising:

a central auger mechanism that moves pills through a body of the toothbrush handle, a terminal end of said auger mechanism pushes the pills through a port in the toothbrush handle, a dispensing means with a safety mechanism, said safety mechanism disables said dispensing means unless said dispensing means is placed in an actuated position, said safety mechanism comprises at least one projection extending from an engaging plate, said engaging plate is mounted on a coil spring that is affixed to an inner side of said dispensing means, said at least one projection is received in a corresponding at least one recess in a lower end of said auger mechanism such that said coil spring pushes said dispensing means away from said auger mechanism when said dispensing means is in a non-actuated position, said projection does not engage said recess so that said dispensing means has no effect on said auger mechanism, and when said dispensing means is actuated, said projection engages said recess so that said auger mechanism is in communication with said dispensing means, and when said dispensing means is rotated, said auger mechanism is also rotated so that a terminal end of said auger pushes a pill out through said port and a stop means to ensure that only one of the pills is dispensed per each actuation of the dispensing means, said stop means comprises a first stop projection and a second stop projection, said first stop projection protrudes inward from an inner side of said dispensing means, said second stop projection protrudes outward from an upper surface of an engaging plate, said first stop projection contacts said second stop projection during each revolution of the auger mechanism, thereby prohibiting further rotation of said auger mechanism; such that when said dispensing means is actuated, said dispensing means causes said auger mechanism to rotate through one revolution, thereby dispensing one of said pills through said port.

* * * * *